United States Patent [19]

Evans et al.

[11] Patent Number: 4,671,725

[45] Date of Patent: Jun. 9, 1987

[54] BARGE TIPPLERS OR DUMPERS

[75] Inventors: David A. Evans; Paul J. Dowden, both of Bristol, England

[73] Assignee: DRG (UK) Limited, Bristol, England

[21] Appl. No.: 719,148

[22] Filed: Apr. 2, 1985

[30] Foreign Application Priority Data

Apr. 2, 1984 [GB] United Kingdom ..... 8408433
Jul. 20, 1984 [GB] United Kingdom ..... 8418503

[51] Int. Cl.[4] ..... B65G 67/48; B65G 69/20

[52] U.S. Cl. ..... 414/137; 210/525; 414/358; 414/581; 414/681; 414/778; 414/786

[58] Field of Search ..... 414/133, 137, 138, 139, 414/354–356, 358–362, 364–366, 368, 371, 372, 382, 386, 678, 681, 778, 786, 575, 581; 210/513, 525, 767; 406/109; 298/17.5, 17.8

[56] References Cited

U.S. PATENT DOCUMENTS

| | | | |
|---|---|---|---|
| 17,114 | 4/1857 | Pearce et al. | 414/358 |
| 1,145,907 | 7/1915 | Lovell | 414/366 |
| 1,823,172 | 9/1931 | Schon | 414/137 |
| 2,179,100 | 11/1939 | Ramsay | 414/358 |
| 2,677,575 | 5/1954 | Phillips | 298/17.5 X |
| 3,216,569 | 11/1965 | Crundall | 210/767 |
| 3,428,193 | 2/1969 | Miller | 414/137 |
| 4,382,418 | 5/1983 | Ray | 414/139 |
| 4,432,688 | 2/1984 | Schmidt | 414/358 |

FOREIGN PATENT DOCUMENTS

| | | | |
|---|---|---|---|
| 1010010 | 6/1957 | Fed. Rep. of Germany | 414/358 |
| 550740 | 12/1922 | France | 414/358 |
| 678607 | 1/1930 | France | 414/138 |
| 1300883 | 7/1962 | France . | |
| 477625 | 1/1938 | United Kingdom . | |
| 904316 | 8/1962 | United Kingdom . | |
| 573425 | 9/1977 | U.S.S.R. | 414/359 |
| 600059 | 3/1978 | U.S.S.R. | 414/355 |
| 954096 | 8/1982 | U.S.S.R. | 210/767 |

*Primary Examiner*—Leslie J. Paperner
*Attorney, Agent, or Firm*—Cushman, Darby & Cushman

[57] ABSTRACT

A tippling installation for the discharge of bulk goods from large barges comprises a dry basin in which a trough-shaped cradle can have its ends sealed against opposite end walls of the basin in which there are lock gates. The cradle provides a holding vessel into which the barges are floated through the lock gates. After closing the gates and draining the cradle, the barge is tipped by rolling the cradle sideways along guide and support tracks which provide positive location while the barge is held clamped in the cradle. The contents of the barge are discharged into a receiving space from which any liquid is drained to separate it from the discharged solids that are then collected. The arrangement is able to prevent pollution of the waterway by the escape of any of the barge contents during discharge. Because they roll on fixed supports relatively little lifting efforts needs to be expanded and very large barges can be handled.

13 Claims, 5 Drawing Figures

BARGE TIPPLERS OR DUMPERS

BACKGROUND OF THE INVENTION

This invention relates to tipplers or dumpers for discharging bulk materials from barges.

In order to use transport barges efficiently, it is desirable to discharge their contents as quickly as possible. It is known to discharge relatively small vessels by a tippling mechanism that lifts a laden barge from the water and overturns it to allow its contents to fall onto a stock heap at the waterside (GB No. 1154 932). Such a discharge method is impractical for larger barges, however, and bulk material conveying equipment, such as bucket chains, are employed to remove the material from the barge while it remains moored in the waterway.

When using barges to transport bulk material it is often impossible to prevent water entering the cargo space. Although this may not have any adverse affect on cargos such as coal or mineral ores, there is a problem in dealing with the contaminated water which is discharged with the cargo and which can cause unacceptable pollution if allowed to escape into the waterway.

One solution is to remove a small amount of cargo to allow a pump to be lowered to the bottom of the cargo space and draw off the water collected there to settling tanks or the like before the main bulk of the cargo is discharged by the known types of material handling equipment. This is a lengthy procedure, however, and the discharge turn-round time becomes unacceptably long.

SUMMARY OF THE INVENTION

According to one aspect of the present invention, there is provided a method of discharging bulk material from a barge wherein the barge is floated into a cradle in a dry basin, the water then being drained from the cradle and, with the barge secured within it, the cradle is rolled to a tipped position to allow the contents of the barge to fall into a receiving space in the basin, and any liquid present in the contents being there separated from the solids for disposal.

According to another aspect of the invention, there is provided a barge tippling installation comprising a dry basin in which a cradle provides a holding vessel into which the barge can be floated, means for draining the water from the cradle, means for securing the barge in the cradle and for rolling the cradle to a tipped position to allow the barge contents to fall into a receiving space in the basin, and means operable in said receiving space to separate liquid from the solid material discharged and to collect the solid material.

More particularly, an installation according to the invention may comprise a dry basin having opposed end walls, a trough-form cradle extending between said end walls and means for forming a seal between the ends of the cradle and said walls, whereby the cradle can provide a water-filled holding space into which the barge can be floated through a sealable gate in at least one of said end walls, means for releasing said cradle sealing means after sealing said gate to isolate the cradle, means for draining the water from the isolated cradle into a holding means from which it can be pumped away, means for rolling the cradle, with the barge secured in it, over guide and support means in the basin to discharge the contents of the barge into a laterally offset receiving space in the basin, drainage and treatment means for liquid discharged with the contents into said receiving space for separating and decontaminating said liquid and reclaimer means operable in said receiving space for removing the discharged solids from the installation.

The handling of the large mass like the cradle with the loaded barge in such a way as to ensure its positioning at a chosen location with a degree of accuracy can give problems especially as it is desirable to be able to move the cradle repeatedly to and fro between specified end positions without time-consuming and difficult adjustments. It is necessary not only to control the rolling limits but also to avoid skewing movements. In principle, the use of rolling guides in the form of a series of parallel gear tooth racks might be employed, but this is impractical not only on the grounds of cost but also because such a mechanism would be vulnerable to even small dimensional changes as will occur continually and to disturbance by the presence of foreign matter, which may be difficult to prevent at a discharge site for bulk materials.

According to a preferred feature of the invention, therefore, the cradle is supported and guided on a plurality of parallel guides which each comprise a series of support members spaced in a row and a complementary series of spaced engagement elements, spaced in a row along the outer surface of the cradle, the rolling movement of the cradle causing sequential engagement of the support and engagement elements of the parallel guides so that the cradle with the barge in it is positively located at each stage of its rolling movement.

Generally, the curved outer surface of the cradle will not have a constant radius of curvature, and said elements of each row are preferably at a smaller spacing where the radius of curvature is smaller.

Each element of said series of support elements or of said series of engagement elements may comprise a fixed carrier and a projecting member mounted in said carrier with a limited freedom of movement in the direction of the rolling movement, the complementary series of elements having recesses to receive said projecting members. More specifically the projecting members may be in the form of substantially cylindrical bodies with axes extending laterally to the path of rolling movement. Such bodies may be arranged to be held captive in their carriers while still having the limited freedom of movement that allows them to accommodate minor dimensional changes.

By way of example, an embodiment of the invention is illustrated in the accompanying schematic drawings.

DESCRIPTION OF THE PREFERRED EMBODIMENT

Figure 1:
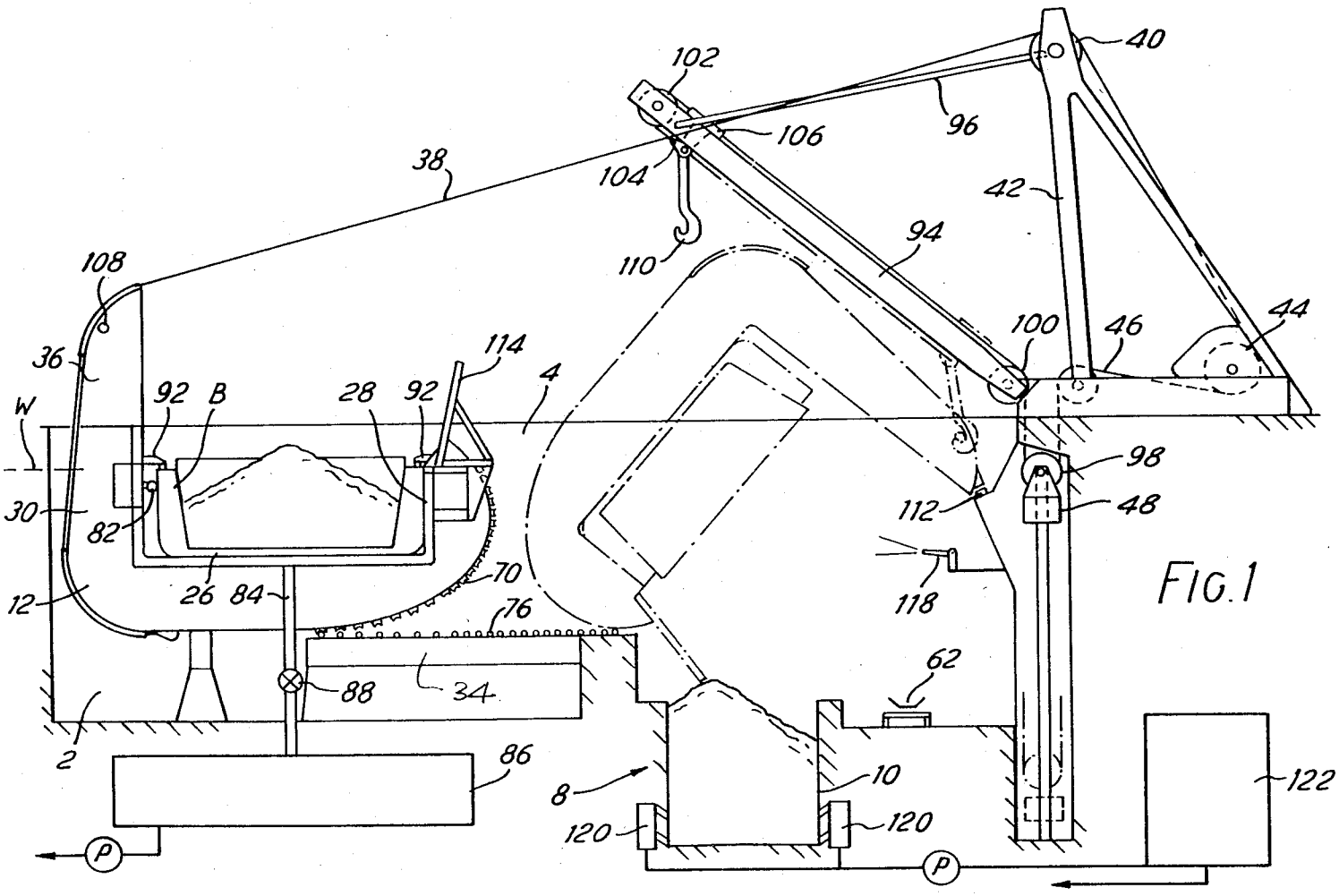
FIG. 1 is a transverse cross-section of a discharge installation according to the invention, showing the tipping of a laden barge.
Figure 4:
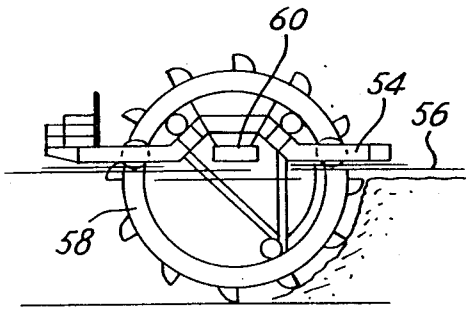
FIG. 4 is an end elevation of the drum reclaimer as seen in the direction of the arrow IV in FIG. 2.

The installation comprises a dry basin 2 sunk below the level of a waterway W (indicated approximately midway between its high and low levels) for the barges and enclosing between its end walls 4 a receiving station 6 for laden barge B and a dumping station 8 with a trench 10 for receiving the barge cargo. A barge cradle 12 in the form of an open-ended trough disposed in the basin is shown in its rest position in FIGS. 1 and 2. In cooperation with the end walls 4 of the basin, in which inflatable seals 16 are located to engage the trough ends, the cradle is able to provide a watertight lock into which a barge can be floated. To give access to the lock, entry and exit lock gates 24 are provided in the basin end walls 4 within the areas circumscribed by the seals 16.

In more detail, the cradle comprises a bottom wall 26 and side walls 28 that define the trough. For structural support there are a series of transverse U-frames 30 at intervals along the length of the cradle and a series of longitudinal beams 32. The cradle rests, through the bottom edges of the U-frames, on support and guide tracks 34 extending across the receiving station to the trench 10.

The side limb of each U-frame remote from the dumping station has an extension 36 projecting somewhat higher than the limb on the discharge side and a series of ropes 38 are secured to the extensions 36 and pass over guide pulleys 40 located above the basin on support frames 42 at the side of the dumping station to winches 44. A second group of ropes 46 wound oppositely onto the winches 44 have counter-weights 48 suspended on them.

Associated with the dumping station is a drum reclaimer 52 which may be of generally conventional design. It comprises a carriage 54 arranged to run on tracks 56 along the sides of the trench 10 and on which is mounted a reclaimer drum 58 with buckets around its periphery. By rotation of its drum as the carriage 54 progresses along the trench, the material in the trench is collected in one pass and transferred through a first transverse conveyor 60 also mounted on the carriage to a take-off conveyor 62 that runs by the side of the trench. An "ambush" or parking position (not shown) of the drum reclaimer is provided by an extension of the trench beyond the length of the cradle 12.

Figure 5:
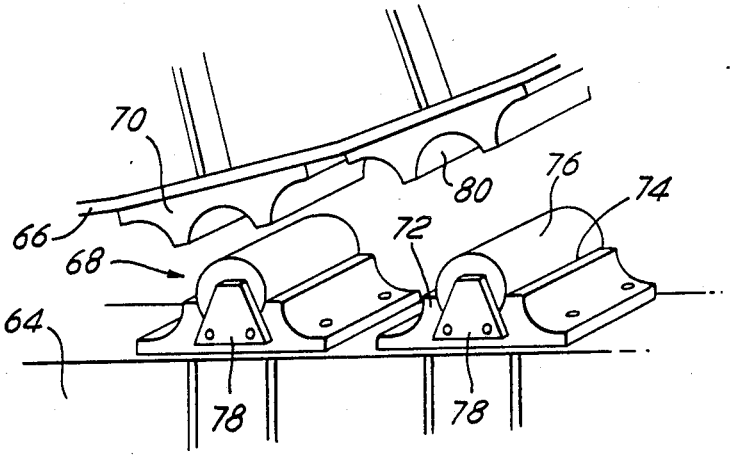
FIG. 5 is a detail oblique view of elements of one of the guide tracks for the tippler cradle.

Referring more particularly to FIG. 5, the support and guide tracks 34 comprise parallel rolled-steel sections 64 on concrete foundations, the top flanges of the sections being coincident with outer flanges 66 of transverse U-frames 30 of the cradle. A series of support elements 68 along the top surface of each section 64 cooperate with engagement elements 70 on the outer curved flange 66 of each frame 30 to transmit the load of the cradle and barge to the foundations. As the cradle is tipped, the support loads are transferred to successive pairs of support and engagement locating elements of each guide track, each pair in turn transmitting the full support load assumed by their respective guide track.

In more detail each support element 68 comprises a carrier 72 bolted to the top flange 66 and having a seating 74 for a cylindrical bearing pin 76 located on a horizontal axis extending transversely to the guide track. The radius of curvature of the seating 74 is slightly larger than the radius of the bearing pin itself, so that the pin is able to move to and fro in the direction of the guide track to a limited extent. It is, however, held captive in the seating by trapping elements 78 at each end. The engagement elements 70 on the outer flange of the cradle transverse frames are of corresponding form to the carrier 72 of the engagement elements with a similar arcuate seating 80 for contact with the bearing pin. In both instances, these arcuate seating subtend less than a full semi-circle, so that there remains a gap between the opposed elements when the bearing element is engaged between them. The bearing pins may be held in the upper engagement elements 70 instead of the elements 68, but by occupying the lower elements they prevent the deposite of foreign matter in the seatings.

Figure 2:
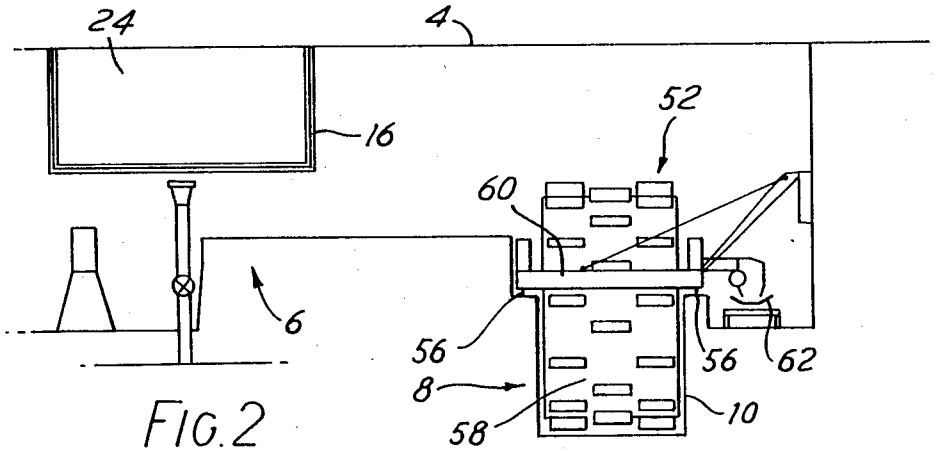
FIG. 2 is a similar view showing reclamation of the tipped material, and with the barge cradle and its associated rolling and tipping mechanism omitted.
Figure 3:
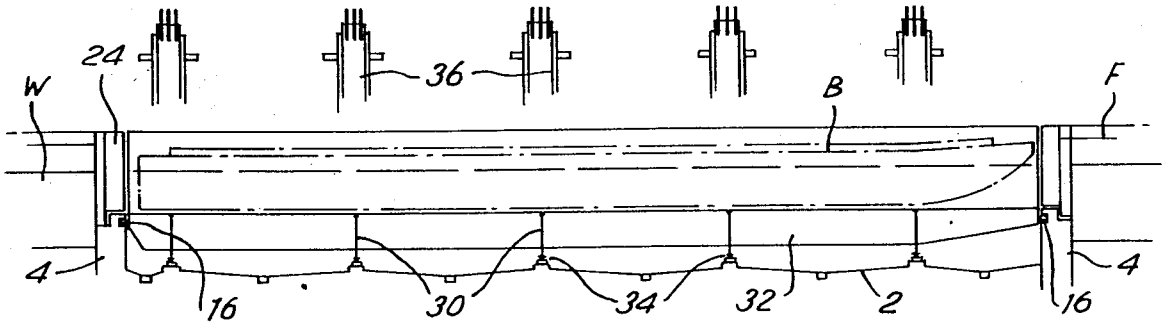
FIG. 3 is a longitudinal section on the line III—III in FIG. 1.

In operation, starting with the installation in the position shown in FIG. 1, with the reclaimer in its parking position and while the cradle and the trench are empty, the end wall seals 16 are inflated to seal with the ends of the cradle and the cradle is flooded to the level of the waterway by opening valves (not shown) connecting the trough to the waterway. The entry lock gate is opened to float in the laden barge B and is closed again while the barge is positioned at the discharge side of the cradle by extending push rams 82 mounted in the opposite side of the cradle. Conduits 84 extend between the cradle and a sump 86 at a lower level than the cradle and are provided with shut-off valves 88 that can now be opened to drain the water in the cradle, to leave the barge resting on the bottom of the cradle. The water collected in the sump 86 is pumped back into the waterway as the operation of the dumper proceeds.

Top clamps 92 which may be of a form generally known for rail car dumpers, can now be lowered to engage the side walls of the barge so as to secure it firmly in place in the cradle. Preferably the barge is so positioned longitudinally of the cradle that the top clamps engage it at locations of its transverse bulkheads, and it is also preferred that the U-frames 30 of the cradle are coincident with the barge transverse bulkheads.

At this stage, with the barge located in the drained cradle and isolated from the waterway by the closed lock gates, the end wall seals are deflated to free the ends of the cradle. The winches 44 are now started to haul in the ropes 38 so tilting the cradle and barge as the U-frames roll along the guide tracks, which throughout support the weight of the cradle and its contents.

The spacing between the support and engagement elements 68, 70 along the direction of each guide track varies, as is shown in FIG. 1, so that they are set closer together as the radius of curvature of the cradle frame becomes smaller. The arrangement is intended to ensure that the rolling movement proceeds relatively smoothly as the loads are transferred from one bearing pin to the succeeding bearing pin. The limited freedom given to the bearing pins to move slightly in their seatings assists in smoothing the transfer of the support loads.

The arrangement provides a relatively simple means of accommodating quite large manufacturing and assembly tolerances and also of accepting minor dimensional variations, e.g. due to thermal expansion or to material strain, in operation. It nevertheless is able to ensure the relatively precise location of the cradle at its end positions and, above all, to ensure that the cradle cannot skew, as might indeed be possible due to variations in the tensions on the winch cables if no positive location were provided.

With the counter-weights 48 there are associated respective jib arms 94 connected to the support frames 42 by stay rods 96. The rope 46 of each counterweight extends from the winch 44, around counter-weight suspension pulley 98, over guide pulleys 100, 102 to have its end secured at 104 to a trolley 106 that can run along the jib arm. During the initial tilting of the cradle, while the rotation of the winches pays out the ropes 46 the trolleys are held at the top of the jib arms by the weight of the counter-weights and the counter-weights discend as the cradle tips, so supplementing the action of the winch drive. As the loaded cradle approaches a point of balance on the guide and support tracks, pins 108 on the extensions 36 engage in hooks 110 suspended from the trolleys. Continued tipping of the cradle therefore draws the trolleys down their jib arms and although the ropes 46 continue to be paid out by the winches the descent of the counter-weights stops and in the final part of the cradle movement the counter-weights are drawn upwards. As a result, the movement of the cradle and barge is stabilised and the counter-weights provide an assisting force for initiating the return of the cradle and emptied barge. To limit movement beyond the end tipped position of the cradle, at an angle of about 130°, shown in broken lines in FIG. 1, emergency buffers 112 are provided.

It will be understood that material will begin to fall from the barge before the fully tipped position is reached. A split plate 114 on the discharge side of the cradle provides a chute-like guide for the flow of material from the barge into the trench. The discharge will deposit any water in the barge, as well as the solid cargo, into the trench 10. If desired, the barge can be cleaned by hose jets 118 while tipped and the dirty water from this operation will also be collected in the trench.

Associated with the trench are drainage louvres (not shown) which permit water dumped with the cargo to be pumped off through dewatering sluices 120 to treatment plant 122, which can be of entirely conventional form, such as settling ponds or flocculation tanks or other water-cleaning means, where the water is cleaned before it is returned to the waterway. The solid material is retrieved from the trench by the drum reclaimer 52 which can begin to operate as soon as the cradle begins to return from its tipped position.

Meanwhile, with the cradle back in its original position and the barge top clamps released, the end wall seals 16 are inflated again and the trough flooded to the level of the waterway. Both lock gates 16 are opened, and the next laden barge moved into the trough, pushing the empty barge out. With the closure of both lock gates the tipping procedure can begin again, the reclaimer having cleared the trech during the changeover.

It will be noted that the weight of the barge is supported throughout by the cradle U-frames 30 that rest continuously on the solid foundations of the basin. It is therefore possible to design such an installation to handle the largest barges without needing massive lifting mechanisms and excessive power consumption. (The illustrated example is intended to handle barges some 60 meters in overall length with a 1500 tonne cargo capacity.) Nor is any special adaptation of the barges required. The installation is nevertheless able to offer a working method that prevents or limits the escape of contaminated water while permiting a turn-round time camparable with that for a barge that is emptied by bucket-chain reclaimers without any provision for retaining contaminated water.

It may be mentioned here that the arrangement for support and guidance of the cradle in its rolling movement is more generally applicable to such movement of other heavy objects. The present invention therefore comprehends means for rolling a heavy object across a basal support, comprising a plurality of parallel guides along which the object is displaced, each said guide comprising a series of spaced support elements fixed in a row along the basal support, and complementary spaced engagement elements fixed in corresponding rows on a curved outer surface of the object to rest upon the support elements, the application of a rolling force to the object to draw it along the direction of the guides causing a sequential engagement of pairs of said support and engagement elements of each guide, whereby the object is positively located at each stage in its rolling movement.

We claim:

1. A barge dumping installation for unloading the contents of a barge, comprising:

a dry basin, having opposite end walls and sealing means provided at said end walls, means defining a receiving space in said basin for the barge contents, a cradle in said basin providing a holding vessel into which the barge can be floated and extending with its ends adjacent said end walls so that said sealing means seals the interior of the cradle from the basing and having at least one curved exterior side, the radius of curvature of which decreases from the bottom up the side, means connected to said cradle for draining the water from the cradle while sealed, means on said cradle for securing the barge into the cradle, means for rolling the cradle across a support surface within the dry basin from an upright position to a tipped position laterally offset from said receiving space and beyond the vertical to allow the contents of the barge to fall into said receiving space in the basin, and means connected to said receiving space for separating liquid from the solid material discharged into said receiving space and for collecting the solid material from said space.

2. A barge dumping installation according to claim 1 wherein a lock gate is provided in at least one said end wall within the area circumscribed by said sealing means, for entry and exit of the barges.

3. A barge dumping installation according to claim 1 wherein the cradle comprises a series of transverse U-frames and support and guide tracks are disposed in the basin on which the cradle rests through said U-frames.

4. A barge dumping installation according to claim 1 wherein drive means are connected to the cradle to displace it from its upright position and counterweight means are displaceable with the operation of said drive means so as to descend during the initial rolling movement of the cradle with its barge, thereby to assist said rolling movement.

5. A barge dumping installation according to claim 1 wherein liquid spray means are provided in said basin for cleaning of the barge interior while the barge is tipped in its tipped position, the cleaning liquid thereby being collected in the receiving space for disposal.

6. A barge dumping installation according to claim 1 wherein a plurality of parallel guides are provided in the basin for support and guidance of the cradle in its rolling movements, said guides each comprising a series of support elements spaced in a fixed row along the length of the guide, and a complementary series of engagement elements fixed in a row to the outer surface of the cradle, the rolling movement of the cradle causing sequential engagement of the support and engagement elements whereby the cradle with the barge in it is positively located at each stage in its rolling movement.

7. A barge dumping installation according to claim 6 wherein said elements of said guide are at a smaller spacing as the radius of curvature is smaller.

8. A barge dumping installation for unloading the contents of a barge, comprising a dry basin, a receiving space in said basin for the barge contents, a cradle in said basin providing a holding vessel into which the barge can be floated, means connected to said cradle for draining the water from the cradle, means on said cradle for securing the barge in the cradle and means for rolling the cradle from an upright position to a tipped position laterally offset from said receiving space to allow the contents of the barge to fall into said receiving space in the basin, including drive means connected to the cradle to displace said cradle from its upright position, counterweight means displaceable with the operation of said drive means so as to descend during the initial rolling improvement of said cradle with its barge, thereby to assist rolling, and means for lifting said counterweight in a final stage of said rolling movement to a fully tipped position, thereby to assist the return of the cradle after tipping the barge contents, and means connected to said receiving space for separating liquid from the solid material discharged in said receiving space and for collecting the solid material from said space.

9. A barge dumping installation for unloading the contents of a barge, comprising a dry basin, a receiving space in said basin for the barge contents, a cradle in said basin providing a holding vessel into which the barge can be floated, means connected to said cradle for draining the water from the cradle means on said cradle for securing the barge in the cradle and means for rolling the cradle from an upright position to a tipped position laterally offset from said receiving space to allow the contents of the barge to fall into said receiving space in the basin, including a plurality of parallel guides in the basin for support and guidance of the cradle in its rolling movements, said guides each comprising a series of support elements spaced in a fixed row along the length of the guide, and a complementary series of engagement elements fixed in a row to the outer surface of the cradle, the rolling movement of the cradle causing sequential engagement of the support and engagement elements whereby the cradle with the barge in it is positively located at each stage in its rolling movement, each element of either the series of support elements or the series of engagement elements being a carrier and/or projecting member mounted in said carrier with a limited freedom of movement in the direction of the rolling movement, the other of said series having recesses for receiving said projecting members.

10. A barge dumping installation according to claim 9 wherein the projecting members are in the form of substantially cylindrical bodies with axes extending laterally to the path of the rolling movement, and means are provided for holding said bodies captive in their carriers.

11. A barge dumping installation for unloading the contents of a barge, comprising a dry basin having opposed end walls, a trough-form cradle extending with its ends adjacent said end walls, and means for forming a seal between the ends of the cradle and said walls, whereby the cradle can provide a water-filled holding space, said cradle having at least one curved exterior side, the radius of which decreases from the bottom up the side, a gate in at least one of said end walls for permitting a loaded barge to be floated into said holding space, means for sealing said gate to isolate the cradle interior with the barge floating within it, means for draining the water from the isolated cradle while sealed into a holding means from which it can be pumped away, guide and support means in the basin extending laterally of the cradle, means for rolling the cradle, with the barge secured to it, over said guide and support means to a tipped position laterally offset from holding space, a laterally offset receiving space being provided in the basin for receiving the contents discharged from the tipped barge, drainage and treatment means for liquid discharged with the solid contents into said receiving space for separating and decontaminating said liquid, and reclaimer means for operation in said receiving space to remove the discharge solid contents from the insallation.

12. A method of discharging bulk material from a barge, wherein the barge is floated into a cradle in a dry basin, sealed within said cradle, the water then being drained from the cradle and, with the barge secured within it, the cradle is rolled along a support surface within the dry basin and along one of the curved sides of said cradle, the curvature of which decreases from the bottom up the curved side to a tipped position beyond the vertical to allow the contents of the barge to be discharged into a laterally offset receiving space in the basin, and any liquid present in the contents being there separated from the discharged solids for disposal.

13. A method according to claim 12 wherein the solids discharged into the receiving space are removed from that space during the return of the unloaded barge and the positioning of a succeeding loaded barge in the cradle.

* * * * *